US006478374B1

(12) United States Patent
Sinoway

(10) Patent No.: US 6,478,374 B1
(45) Date of Patent: Nov. 12, 2002

(54) STACKABLE FURNITURE AND A SYSTEM AND METHOD FOR STACKING SAME

(76) Inventor: Morlen Sinoway, 2035 W. Wabansia Ave., Chicago, IL (US) 60647

( * ) Notice: Subject to any disclaimer, the term of this patent is extended or adjusted under 35 U.S.C. 154(b) by 0 days.

(21) Appl. No.: 09/652,441

(22) Filed: Aug. 31, 2000

(51) Int. Cl.[7] ..... C08C 321/00; C08C 323/00; C08C 381/00

(52) U.S. Cl. ..... 297/239; 297/461; 297/462

(58) Field of Search ..... 297/239, 461, 297/462; D6/349, 353; 108/91

(56) References Cited

U.S. PATENT DOCUMENTS 2,933,850 A * 4/1960 Martin
3,669,494 A * 6/1972 Lohmeyer ..... 297/462 X
3,890,658 A * 6/1975 Petersilie
4,046,421 A * 9/1977 Spound et al.
4,212,090 A * 7/1980 Ehrlich ..... 297/239 X
4,437,704 A * 3/1984 Hovsepians
4,867,504 A * 9/1989 Johnson ..... 297/239 X
5,158,512 A * 10/1992 Irwin et al.
5,370,447 A * 12/1994 Schneider ..... 297/462 X
D395,144 S * 6/1998 McMahon
D397,879 S * 9/1998 Hutton

* cited by examiner

*Primary Examiner*—Robert W. Gibson, Jr.
(74) *Attorney, Agent, or Firm*—Patents & TMS, P.C.

(57) ABSTRACT

A cushion, a system of cushions, and a method for stacking cushions are provided. The cushion may have two sections or may be integrally formed. The cushion may have an opening within the lower section of the cushion to receive a portion of another cushion. When placed upon a second similarly structured cushion, a system of cushions results. The cushions may be stacked for the purposes of height manipulation, space conservation, or the like. The cushions may also be transported from one location to another by providing wheels on the cushion or by a dolly.

23 Claims, 2 Drawing Sheets

STACKABLE FURNITURE AND A SYSTEM AND METHOD FOR STACKING SAME

BACKGROUND OF THE INVENTION

The present invention generally relates to a furniture piece and/or stackable object, such as a seat, a table, a cushion or the like. A system of stackable objects and a method for stacking the objects are also provided. More specifically, the present invention relates to a cushion capable of stacking on another similarly structured cushion to obtain a specific cushion height or to satisfy certain space requirements.

It is, of course, generally known to provide a cushion that may serve, for example, as a seat or a table. However, known cushions may not be adaptable for a user's purpose, i.e. sitting, resting objects upon, etc. Furthermore, known cushions are not generally designed to be conveniently arranged or consolidated for purposes such as space conservation. In addition, the size and/or shape of known cushions do not provide simplified transport of the cushions from one location to another.

A need, therefore, exists for an improved cushion that may be manipulated to a desired height by stacking the cushion upon one or more similarly structured cushions. A further need exists for a cushion that can be conveniently stacked, allowing for conservation of space. And, a need exists for a system of stackable cushions that may be simply transported from one location to another. Still further, a need exists for an improved method for providing cushions that may be stacked and transported from one location to another.

SUMMARY OF THE INVENTION

The present invention provides a cushion that may serve as a seat, table, or other furniture item. The present invention also provides a cushion that may be stacked upon similarly structured cushions for the purpose of height manipulation as well as space conservation. Lastly, the present invention provides a system of cushions and a method for stacking cushions.

In an embodiment of the present invention, an apparatus is provided. The apparatus may have a first section having a top side and a bottom side. The apparatus may also have a second section having a top side and a bottom side wherein the second section is larger than the first section and further wherein the bottom side of the first section is positioned on the top side of the second section. The apparatus may also have an opening formed in the bottom side of the second section.

In an embodiment, the first section is circular in shape.

In an embodiment, the second section is circular in shape.

In an embodiment, the first section and the second section are integrally formed.

In an embodiment, the first section and the second section are constructed from foam.

In an embodiment, the first section and the second section are constructed from rubber.

In an embodiment, a fastener secures the second section to the first section.

In an embodiment, wheels are associated with the second section.

In an embodiment, material covers the first section and the second section.

In an embodiment, the opening in the bottom side of the second section has an exterior shape substantially the same as an exterior shape of the first section.

In another embodiment of the present invention, a system is provided. The system may have a first cushion having a first section having a top side and a bottom side, and a second section having a top side and a bottom side wherein the first section is positioned on the second section, and further wherein an opening is provided in the bottom side of the second section. The system may also have a second cushion having a first section wherein the opening of the first cushion receives the first section of the second cushion.

In an embodiment, a second section is positioned adjacent to the first section of the second cushion.

In an embodiment, a foam ring is positioned in the opening of the second section of the first cushion.

In an embodiment, the first cushion is integrally formed.

In an embodiment, the second cushion is integrally formed.

In an embodiment, the system may further have wheels associated with the second cushion.

In another embodiment, a method is provided. The method has the steps of: providing a first cushion having a first section having a top side and a bottom side, and a second section having a top side and a bottom side, wherein the first section is positioned on the second section, and further wherein the second section has an opening formed in the bottom side of the second section; providing a second cushion having a first section; and positioning the first section of the second cushion in the opening of the first cushion.

In an embodiment, the method may further have the step of providing an opening in the second cushion.

In an embodiment, the method may further have the step of providing wheels on the second cushion.

In an embodiment, the method may further have the step of securing the first section of the first cushion to the second section of the first cushion.

It is, therefore, an advantage of the present invention is to provide an apparatus, a system and a method for stacking the apparatus onto another apparatus to provide height manipulation.

Another advantage of the present invention is to provide an apparatus, a system and a method for stacking the apparatus onto another apparatus to provide space conservation.

Still another advantage of the present invention is to provide an apparatus, a system and a method for stacking the apparatus onto another apparatus to provide transport of the invention from one location to another by use, for example, of a dolly.

Another advantage of the present invention is to provide an apparatus, a system and a method for stacking the apparatus onto another apparatus to provide a decorative article of furniture.

Another advantage of the present invention is to provide an apparatus, a system and a method for stacking the apparatus onto another apparatus to provide adaptability in the use of an article of furniture as a seat, table, and the like.

Another advantage of the present invention is to provide an apparatus, a system and a method for stacking the apparatus onto another apparatus to provide increased space conservation due to the simplicity of the shape of the apparatus.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally provides a cushion or other like piece of furniture. The present invention further provides a cushion that may be stacked upon a second cushion to create a system of cushions. In addition, the present invention provides a method for stacking cushions to provide, for example, height manipulation, space conservation, and/or transport from one location to another of the stack of cushions.

Figure 1:
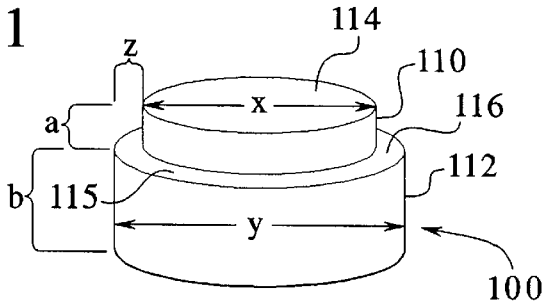
FIG. 1 illustrates a perspective view of an embodiment of a stackable cushion of the present invention.

Referring now to the drawings wherein like numerals refer to like parts, FIG. 1 illustrates a cushion 100 having a lower base 112 having a height "b" and a diameter "y". The interior of the lower base 112 preferably has a cylindrical opening, shown and described in further detail with reference to FIG. 4. The cushion 100 has an upper base 110, preferably circular in shape, with a height "a" and a diameter "x". The upper base 110 may be constructed, for example, of foam, wood, plastic, fiberglass, rubber, metal or carbon fiber, but other materials may be implemented by those skilled in the art. A top plane 114 of the upper base 110 is suitable for use as a seat, table, or other similar purpose. The upper base 110 is preferably attached to a top plane 116 of the lower base 112. The diameter "x" of the upper base 110 is preferably smaller than the diameter "y" of the lower base 112 creating a circular ledge 115 having a width "z", equal to approximately one-half of the difference in the diameter "x" of the upper base 110 and the diameter "y" of the lower base 112. The cushion may be covered, for example, with a single slip cover, or may be covered with a separate slip cover for the upper base 110 and the lower base 112. Alternatively, the upper base 110 and the lower base 112 may be upholstered. In addition, in an embodiment, only the upper base 110 or the lower base 112 may be upholstered. In other embodiments, the upper base 110 may be covered with a slip cover while the lower base 112 may be upholstered or vice versa. Furthermore, the upper base 110 may not be covered while the lower base 112 may be covered by a slip cover or may be upholstered or vice versa. In yet another embodiment, neither the upper base 110 nor the lower base 112 may be covered. In this embodiment, the material, i.e. wood, plastic, foam, rubber, fiberglass or the like, is exposed and not otherwise covered and/or upholstered.

It should be understood that the dimensions "b", "y", "a", "x" and "z" are not limited to the measurements shown and described, but may also be modified to other dimensions by one skilled in the art within the spirit and scope of the present invention. It should be further understood that the present invention is not limited to the shapes shown and described, but may also be implemented as any other known shape or other random shape by one skilled in the art.

Figure 2:
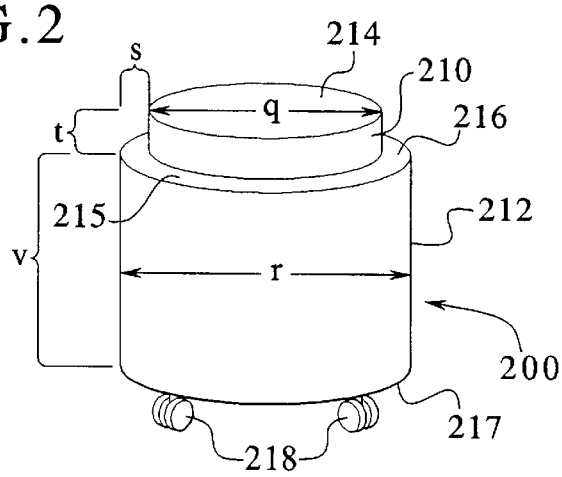
FIG. 2 illustrates a perspective view of another embodiment of a wheeled table of the present invention.

FIG. 2 illustrates another embodiment of a cushion 200 having a lower base 212 with a height "v" and a diameter "r". An interior of the lower base 212 preferably has a cylindrical opening, shown and described in further detail with reference to FIG. 4. However, the embodiment may also have no opening within the interior of the lower base 212. The cushion 200 has an upper base 210 having a height "t" and a diameter "q". A top plane 214 of the upper base 210 is suitable for use as, for example, a seat, a table, or other furnishing purpose. The upper base 210 is attached to a top plane 216 of the lower base 212. The diameter "q" of the upper base 210 is preferably less than a diameter "r" of the lower base 212, creating a circular ledge 215 having a width "s", equal to approximately one-half of the difference in the diameter "q" of the upper base 210 and the diameter "r" of the lower base 212. The ratio of the height "v" of the lower base 212 of the cushion 200 to the height "t" of the upper base 210 of the cushion 200 may be greater than the ratio of the height "b" of the lower base 112 of the cushion 100 to the height "a" of the upper base 110 of the cushion 100. Attached to a bottom edge 217 of the lower base 212 may be wheels 218. Preferably, at least three wheels are attached to the bottom edge 217 of the lower base 212. The cushion 200 may be covered with, for example, a single slip cover, or may be covered with a separate slip cover for the upper base 210 and the lower base 212. Alternatively, the upper base 210 and the lower base 212 may be upholstered. In addition, in an embodiment, only the upper base 210 or the lower base 212 may be upholstered. In other embodiments, the upper base 210 may be covered with a slip cover while the lower base 212 may be upholstered and vice versa. Furthermore, the upper base 210 may not be covered while the lower base 212 may be covered by a slip cover or may be upholstered and vice versa, or, neither the upper base 210 nor the lower base 212 may be covered.

It should be understood that the dimensions "v", "r", "t", "q", and "s" are not limited to the measurements shown and described, but may also be modified to other dimensions by one skilled in the art within the spirit and scope of the present invention. It should be further understood that the present invention is not limited to the shapes shown and described, but may also be implemented as any other known shape or other random shape by one skilled in the art.

Figure 3:
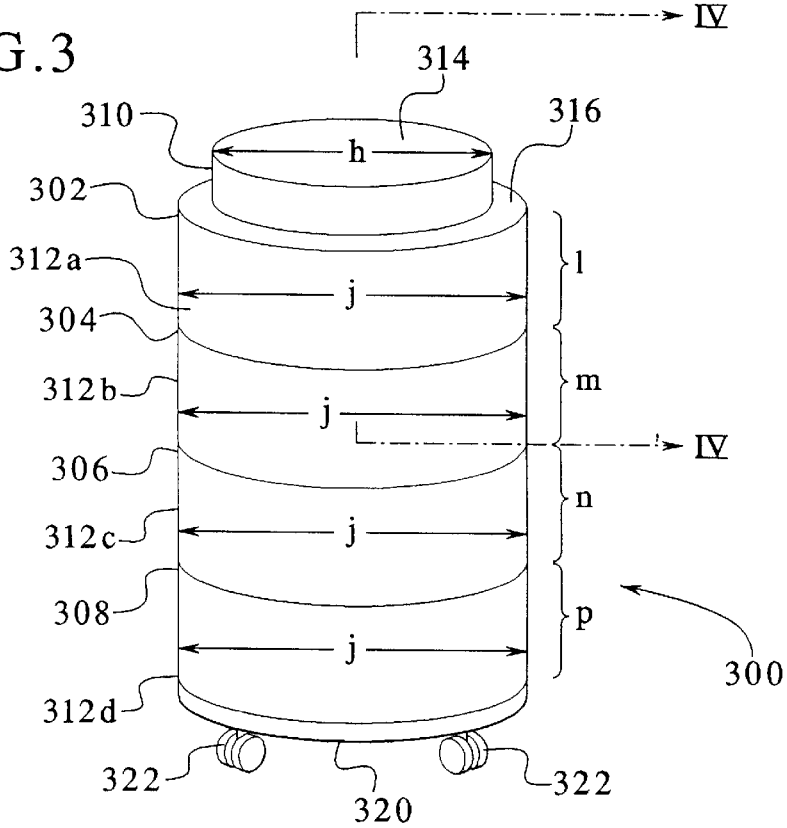
FIG. 3 illustrates a perspective view of yet another embodiment of a system of cushions of the present invention.

FIG. 3 illustrates a system 300 having cushions 302, 304, and 306 stacked upon a cushion 308. The interior of each lower base of each of the cushions 302, 304, 306 and 308 preferably has a cylindrical opening, providing placement of one cushion onto the top plane of another lower base of an adjacent cushion. For example, the system 300 may be created by placing the lower base 312*a* of the cushion 302 onto a top plane of the lower base 312*b* of the cushion 304; placing the lower base 312*b* of the cushion 304 onto a top plane of the lower base 312*c* of the cushion 306; and placing the lower base 312*c* of the cushion 306 onto a top plane of the lower base 312*d* of the cushion 308. Each of the cushions 302, 304, 306 and 308 may have a lower base having a diameter "j". However, heights "l", "m", "n" and "p" of the lower bases of each of the respective cushions may have the same height or the heights may vary. Furthermore, the diameters of the opening in each of the cushions 302, 304, 306 and 308 may vary. However, the opening for a cushion should preferably be receivable in the upper base of another cushion to create the system 300 of cushions.

The cushion 302 has an upper base 310 having a height "g" and a diameter "h". The upper base 310 of the cushion 302 may be constructed of foam, but other materials may be implemented by those skilled in the art. The diameter "h" of the upper base 310 is preferably less than the diameter "j" of the lower base 312*a,* creating a circular ledge 315 with a width "k" equal to approximately one-half of the difference between the diameters "h" of the upper base 310 and the diameter "j" of the lower base 312*a*. The top plane 314 of the upper base 310 of the cushion 302 is suitable for use as a seat, table, or other furnishing purpose. Each of the cushions 302, 304, 306, and 308 may be covered separately by either a single slip cover or separate slip covers for the upper and lower bases of each cushion. Alternatively, each of the cushions 302, 304, 306 and 308 may be upholstered. In addition, each of the cushions may vary the type of coverings for the upper and lower base, such that the upper and lower bases may be covered by a slip cover, upholstery or have no cover.

It should be understood that the dimensions of the cushions 302, 304, 306 and 308 of the system 300 are not limited to the measurements shown and described, but may also be implemented by one skilled in the art as any other dimension within the spirit and scope of the present invention.

The system 300 may be transported by placement on, for example, a dolly 318. The dolly 318 has a base 320 and wheels 322 attached to the base 320. Although only shown in FIG. 3, a dolly 318 may be used to transport a single cushion as well such as the cushion 100 illustrated in FIG. 1. The base 320 of the dolly 318 may be sized to fit within an opening of a lower base of a cushion. In this embodiment, the base 320 of the dolly 318 is in contact with an inside edge of the opening within a lower base of a cushion and may be held in contact with the inside edge of an opening by friction. In another embodiment, a diameter of the base 320 of the dolly 318 may be sized as large as a diameter of a lower base of a cushion. In yet another embodiment, a diameter of the base 320 of the dolly 318 may be sized larger than a diameter of a lower base of a cushion.

Figure 4:
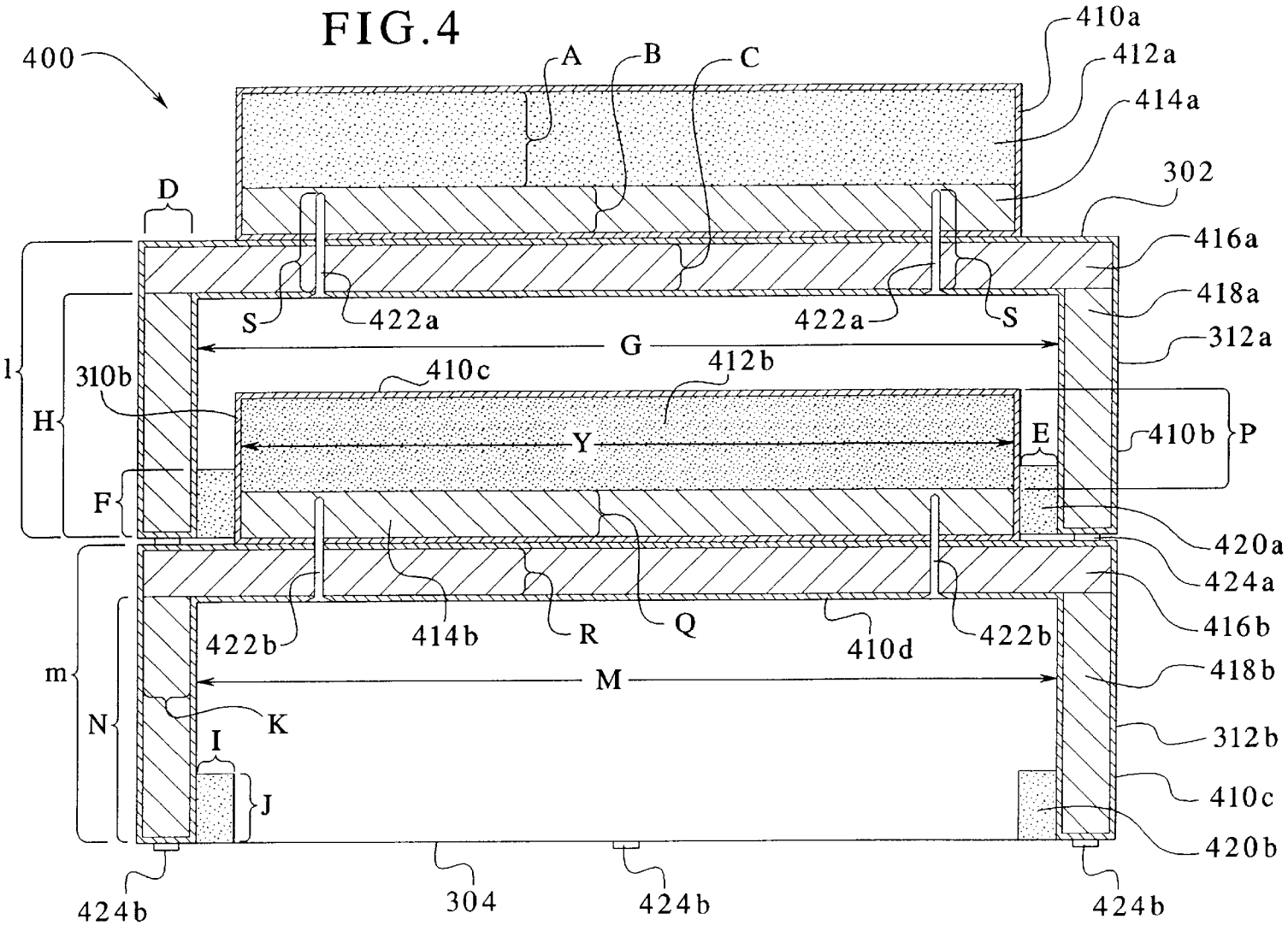
FIG. 4 illustrates a cross-sectional view taken generally along the line IV—IV of FIG. 3.

FIG. 4 illustrates a cross-sectional view 400 taken generally along the line IV—IV of FIG. 3 of the cushion 302 and the cushion 304. In an embodiment, the upper base 310*a* of the cushion 302 may include a foam substance layer 412*a* having a height "A" and a diameter "h". The upper base 310*a* may also include a solid layer 414*a* having a height "B" and a diameter "h". The solid layer 414*a* may be, for example, wood, molded plastic, foam, or the like. A slip cover 410*a,* for example, may be used to cover the upper base 310*a*. Use of the slip cover 410*a* provides interchangeability, allowing different materials or colors to be used. However, the cushion 302 may also be covered with a single slip cover and/or the cushion 302 may be upholstered. In addition, the cushion may vary the type of coverings for the upper base 310*a* and a lower base 312*a,* such that the upper base 310*a* and the lower base 312*a* may be covered by a slip cover, upholstery or have no cover.

The lower base 312*a* of the cushion 302 may have a base 416*a* having a height "C" and a diameter "j". The base 416*a* may further have a base 418*a,* preferably circular, having a height "H" and a diameter "j". The base 418*a* may have an opening having a diameter "G", providing the base 418*a* with a thickness "D". Attached to the interior of the base 418*a* may be an inner foam ring 420*a* having a thickness "E" and a height "F". The lower base 312*a* may also be covered with a slip cover 410*b*. Attached to the bottom edge of the lower base 312*a* may be feet 424*a*. At least three feet 424*a* may be attached to a bottom of the lower base 425*a*.

The lower base 312*a* may be attached to the upper base 310*a* by means of, for example, fasteners 422*a,* such as a set of nails or screws, having a length "S" which project through the base 416*a* of the lower base 312*a* into the solid layer 414*a* of the upper base 310*a*.

The cushion 302 is shown stacked upon the cushion 304. The cushion 304 may have an upper base 310*b*. The upper base 310*b* may include a foam substance layer 412*b* having a height "P" and a diameter "Y". The upper base 310*b* may also include a solid layer 414*b* having a height "Q" and a diameter "Y". The upper base 310*b* may be covered with a slip cover 410*c*. However, the cushion 304 may also be covered by a single slip cover and/or may be upholstered. The cushion 304 may also vary the type of coverings provided for the upper and lower bases such that the upper and lower base may be covered by a slip cover, upholstery or have no cover.

The cushion 304 may also have a lower base 312*b*. The lower base 312*b* has a base 416*b* having a height "R" and a diameter "j". The base 416*b* may be attached to a base 418*b,* preferably cylindrical, having a height "N" and a diameter "j". The base 418*b* has an opening having a diameter "M", providing the base with a thickness "K". Attached to the interior of the base 418*b* is a foam ring 420*b* having a height "J" and a thickness "I". The lower base 312*b* may also be covered by a slip cover 410*d* and/or may be upholstered. Attached to the bottom 425*b* of the lower base 312*b* may be feet 424*b*. Preferably, at least three feet may be attached to the bottom 425*b* of the lower base 312*b*.

The lower base 312*b* may be attached to the upper base 310*b* for example, by fasteners, such as nails or screws 422*b,* having a length "V", which project through the base 416*b* of the lower base 312*b* into the solid layer 414*b* of the upper base 310*b*.

It should be understood that the dimensions provided for the cross-sectional view 400 are not limited to the measurements shown and described, but may also be implemented by one skilled in the art as any other dimensions within the spirit and scope of the present invention.

The cross-sectional view 400 of FIG. 4 illustrates the cushion 302 and the cushion 304 in a stacked position. The foam ring 420*a* in the cushion 302 provides friction between the upper base 310*b* of the cushion 304 and the lower base 312*a* of the cushion 302 to prevent the cushion 302 and the cushion 304 from disengaging from the stacked position.

Another embodiment of the present invention involves formation of the present invention by injection molding, providing a cushion that is continuous, and preferably similar in shape to the cushion 100 illustrated in FIG. 1. The injection molded embodiment is preferably constructed of foam or rubber, but other materials may be implemented by those skilled in the art. The injection molded embodiment may have no cover, may be covered by a single slip cover, or may be upholstered. In addition, the present invention may be integrally formed by fiberglass molding, stamping, die cutting or any other method known by those skilled in the art.

The injection molded embodiment may have an upper portion and a lower portion. The upper portion of the injection molded embodiment is preferably circular in shape. The upper portion may have a top side, which may be used as a seat or table, or for any other furnishing purpose. In addition, the upper portion may have a bottom side which may be determined at the point where the upper portion broadens into the lower portion. The lower portion has a top side which may be determined at the point that the lower portion narrows into the upper portion. The lower portion also has a bottom side which is underneath the injection molded embodiment. The bottom side may have an opening which is preferably cylindrical. Furthermore, the injection molded embodiment may have a foam ring within the interior of the opening. In addition, feet or wheels may be attached at the bottom side of the injection molded embodiment. The injection-molded embodiment may also be stacked upon a second cushion. The second cushion may not be injection molded and may be similar to the cushion 100 illustrated in FIG. 1. The injection molded embodiment may also be transported by use of a dolly.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An apparatus comprising:

a first section having a top side, a bottom side and an edge wherein the edge defines a perimeter of the first section and further wherein the top side of the first section defines a first continuous plane inside the edge of the perimeter and the bottom side of the first section defines a second plane wherein the first plane and the second plane are parallel and substantially equal in dimension defining a height of the first section wherein the height of the top side of the first continuous plane is uniform inside the edge of the perimeter;

a second section having a top side and a bottom side wherein the second section is larger than the first section and further wherein the bottom side of the first section is positioned on the top side of the second section; and an opening formed in the bottom side of the second section.

2. The apparatus of claim 1 wherein the first section is circular in shape.

3. The apparatus of claim 1 wherein the second section is circular in shape.

4. The apparatus of claim 1 wherein the first section and the second section are integrally formed.

5. The apparatus of claim 1 wherein the first section and the second section are constructed from foam.

6. The apparatus of claim 1 wherein the first section and the second section are constructed from rubber.

7. The apparatus of claim 1 further comprising:

a fastener securing the second section to the first section.

8. The apparatus of claim 1 further comprising:

wheels associated with the second section.

9. The apparatus of claim 1 further comprising:

material covering the first section and the second section.

10. The apparatus of claim 1 wherein the opening in the bottom side of the second section has an exterior shape substantially the same as an exterior shape of the first section.

11. A system for stacking articles of furniture, the system comprising:

a first cushion having a first section having a top side and a bottom side, and a second section having a top side and a bottom side wherein the first section is positioned on the second section, and further wherein an opening is provided in the bottom side of the second section; and a second cushion having a first section wherein the opening of the first cushion receives the first section of the second cushion.

12. The system of claim 11 further comprising:

a second section positioned adjacent to the first section of the second cushion.

13. The system of claim 11 further comprising:

a foam ring positioned in the opening of the second section of the first cushion.

14. The system of claim 11 wherein the first cushion is integrally formed.

15. The system of claim 11 wherein the second cushion is integrally formed.

16. The system of claim 11 further comprising:

wheels associated with the second cushion.

17. A method for stacking articles of furniture, the method comprising the steps of:

providing a first cushion having a first section having a top side and a bottom side, and a second section having a top side and a bottom side, wherein the first section is positioned on the second section, and further wherein the second section has an opening formed in the bottom side of the second section;

providing a second cushion having a first section; and positioning the first section of the second cushion in the opening of the first cushion.

18. The method of claim 17 further comprising the step of:

providing an opening in the second cushion.

19. The method of claim 17 further comprising the step of:

providing wheels on the second cushion.

20. The method of claim 17 further comprising the step of:

securing the first section of the first cushion to the second section of the first cushion.

21. An apparatus comprising:

a first section having a top side and a bottom side;

a second section having a top side and a bottom side wherein the second section is larger than the first section and further wherein the bottom side of the first section is positioned on the top side of the second section;

an opening formed in the bottom side of the second section; and a fastener securing the second section to the first section.

22. An apparatus comprising:

a first section having a top side and a bottom side;

a second section having a top side and a bottom side wherein the second section is larger than the first section and further wherein the bottom side of the first section is positioned on the top side of the second section;

an opening formed in the bottom side of the second section; and wheels associated with the second section.

23. An apparatus comprising:

a first section having a top side and a bottom side;

a second section having a top side and a bottom side wherein the second section is larger than the first section and further wherein the bottom side of the first section is positioned on the top side of the second section;

an opening formed in the bottom side of the second section; and material covering the first section and the second section.

* * * * *